United States Patent [19]

Wright

[11] Patent Number: 4,999,660

[45] Date of Patent: Mar. 12, 1991

[54] DUAL CHAMBER PUMP ASSEMBLY AND A REPLENISHMENT SYSTEM FOR A FILM PROCESSOR INCORPORATING SUCH A PUMP ASSEMBLY

[75] Inventor: Thomas S. Wright, Rochester, N.Y.

[73] Assignee: Eastman Kodak Company, Rochester, N.Y.

[21] Appl. No.: 494,354

[22] Filed: Mar. 16, 1990

[51] Int. Cl.[5] ..... G03D 3/06

[52] U.S. Cl. ..... 354/324; 354/322

[58] Field of Search ..... 354/322, 324, 325, 326, 354/327; 417/429, 473, 538, 539

[56] References Cited

U.S. PATENT DOCUMENTS

| | | | |
|---|---|---|---|
| 3,068,886 | 12/1962 | Hixon et al. | 354/298 |
| 3,388,653 | 6/1968 | Mayfield | 354/299 |
| 4,263,995 | 4/1981 | Wahlstedt | 192/35 |
| 4,295,729 | 10/1981 | Kaufmann | 354/324 |
| 4,302,163 | 11/1981 | Hope et al. | 417/473 |
| 4,329,042 | 5/1982 | Libicky et al. | 354/324 |
| 4,486,082 | 12/1984 | Wagner et al. | 354/6 |
| 4,577,950 | 3/1986 | Mackson | 354/324 |

*Primary Examiner*—A. A. Mathews

*Attorney, Agent, or Firm*—G. Herman Childress

[57] ABSTRACT

A dual chamber pump assembly comprises two separate bellows pumps driven from a single motor. The belows pumps can be operated independently, or simultanously, by selectively engaging clutches coupled to the motor and the pumps. A replenishment system for a film processor incorporating such a pump assembly has a plurality of tanks for solutions used in processing film, and each of the pumps is connected to one of the tanks and to a source of replenishment solution for its respective tank. By selectively engaging the clutches for the bellows pumps, the tanks can be replenished independently or simultaneously, as needed.

3 Claims, 2 Drawing Sheets

DUAL CHAMBER PUMP ASSEMBLY AND A REPLENISHMENT SYSTEM FOR A FILM PROCESSOR INCORPORATING SUCH A PUMP ASSEMBLY

BACKGROUND OF THE INVENTION

The present invention relates to a pump assembly of the kind having a single motor for driving a plurality of pumps. Also, the present invention relates to an improvement in a film processor having a plurality of tanks for holding solutions that periodically need to be replenished.

It is known to provide a single motor for driving two or more pumps. One example is a single motor, dual bellows pump Model No. 90885-000 sold by the Gorman Rupp Industries of Belleville, Ohio. Pump assemblies of this kind have two bellows pumps which are driven simultaneously by a single motor. It is known to use such pumps for replenishing solutions in a film processor having a plurality of tanks containing developer and fixer solutions needed for processing film, such as X-ray film. The solutions are depleted during development of film. When the motor is energized the pumps both are operated to simultaneously provide replenishment solutions to each of two tanks. The developer and fixer solutions typically to not need replenishment at the same rates. For example, one solution may need to be replenished 20 percent more than the other solution. Therefore a mechanical adjustment is provided for the bellows pumps which enables one bellows to pump from 0 to 100 percent of the capacity of the other bellows. This adjustment is crude and an inconvenient adjustment for the user. Also, the need for replenishment of the processing solutions is a function of the quantity of film processed in a particular time period and the amount of solution that evaporates from the tank during that time period.

While the replenishment system described above has operated satisfactorily, it suffers some disadvantages. For example, it cannot easily handle the situation where one tank is depleted of solution to an extent requiring replenishment prior to the time the other tank requires replenishment. Under the circumstances, if the motor is operated to replenish the depleted supply in the first tank, the second tank may be excessively replenished, resulting in an inaccurate chemical concentration, or the second tank may be filled beyond its capacity with the excess solution being diverted to a drain. In order to avoid such problems the depleted solution may not be replenished completely. Clearly there is a need to independently provide replenishment solutions to tanks in film processors in order that the precise amount of replenishment fluid can be provided to each tank based on its needs. This could be accomplished by providing two separate independent pumps with different motors, but such unnecessarily increases the cost of the film processor and complicates its controls.

SUMMARY OF THE INVENTION

Accordingly, it is an object of the invention to provide an improved pump assembly having a dual pump chamber and operated from a single motor wherein the individual pumps can be operated independently. Another object of the invention is to improve replenishment of solutions in a film processor by enabling each solution in each of several tanks to be independently replenished without simultaneously replenishing solutions in another tank unless the other tank also needs replenishment solution.

In accordance with one aspect of the invention an improved pump assembly is provided comprising multiple pump chambers. A single drive shaft is used for driving all of the pump chambers, and a single motor is coupled to the shaft for driving the shaft and operating the pumps. A plurality of clutches are provided, each of the clutches being coupled between the shaft and one of the pumps. Means are provided for selectively engaging the clutches individually or simultaneously in order to individually or simultaneously operate each of the pumps.

In accordance with another aspect of the invention an improvement is provided for a film processor having a plurality of tanks for solutions used in processing film. A plurality of pumps are provided for replenishment of solutions in the tanks when portions of solutions are depleted during processing of film. Each of the pumps is connected to one of the tanks and to a source of replenishment solutions for that tank. The improvement of invention comprises a single drive shaft used for driving all of the pumps, and a motor for rotating the shaft about an axis. A plurality of clutches are provided, each of the clutches being coupled to the shaft and, when engaged, to one of the pumps. Means are provided for selectively engaging the clutches, individually or simultaneously, in response to sensing the levels of solutions in the tanks.

BRIEF DESCRIPTION OF THE DRAWINGS

In the following detailed description of the invention reference is made to the accompanying drawings in which.

DETAILED DESCRIPTION OF THE INVENTION

Figure 1:
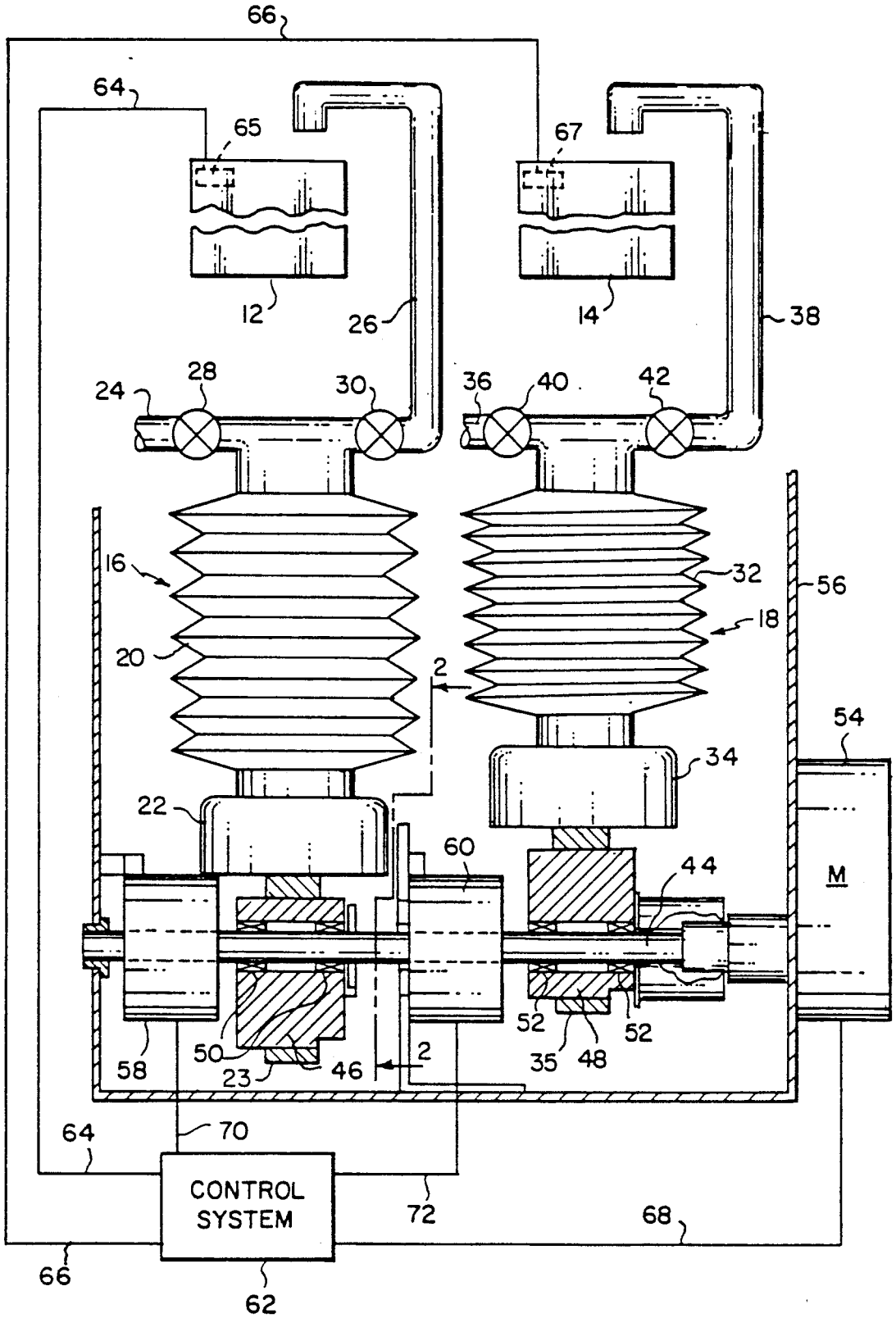
FIG. 1 is a view illustrating an improved replenishment system for film processors or the like in accordance with the present invention, and incorporating the improved pump assembly of the invention, FIG. 1 being partially in elevation and partially diagrammatically illustrating the invention.

The improved replenishment system of the invention is suitable for use with a film processor having a plurality of tanks containing solutions that periodically need to be replenished. For example, two such tanks 12 and 14 are illustrated in the drawings and may receive solutions of developer and fixer as commonly used in film processing apparatus. During processing of film the solutions in the tanks are depleted and need to be replenished in order to maintain the quality of the processing operation. However, the tanks may be depleted at a non-uniform rate. As explained in more detail later, the invention permits the tanks to be replenished independently or simultaneously based on the condition of the solution in each tank.

Tanks 12 and 14 are replenished by two bellows pumps generally designated 16 and 18. Pump 16 comprises a bellows 20 secured at its lower end to a base or mounting member 22. The base has a cylindrical portion 23 that projects downwardly and receives a cam that drives the base in an up and down manner to compress and expand the bellows 20, as explained later. The upper end of the bellow is connected to conduits 24 and 26. Conduit 24 leads to a source of replenishment solution (not shown) for tank 12, and conduit 26 extends from the bellows pump to the tank 12. Check valves 28, 30 are provided between the conduits 24, 26 and the bellows 20. When bellows 20 is expanded from a compressed position to the position illustrated in FIG. 1, a suction is created in conduit 24 and replenishment solution is drawn through the conduit 24 into the bellows through the check valve 28. At this time the check valve 30 is closed. When the base 20 is driven upwardly to compress the bellows 20, solution within the bellows is forced upwardly through check valve 30 and conduit 26 into the tank 12. At this time the check valve 28 is closed. Thus during each cycle of expansion and compression of the bellows 20, solution is drawn from the source and delivered to the tank 12.

Bellows pump 18 is similar in construction to the pump 16. More specifically, pump 18 comprises a bellows 32 and a base 34. The base has a cylindrical portion 35 that projects downwardly for receiving a cam, as explained later. The upper end of the bellows is connected to conduits 36, 38 which have check valves 40, 42 located between the conduits and the bellows. When bellows 32 is expanded, it sucks replenishment solution from a source (not shown) through conduit 36 and check valve 40 into the bellows 32. At this time valve 42 is closed. When the bellows is compressed, replenishment solution within the bellows is forced out of the bellows through check valve 42 and conduit 38 into tank 14. Valve 40 is closed when the bellows is compressed. Pumps of this kind for providing replenishment solutions to tanks in a film processor are well known and need not be described in more detail here.

In accordance with the present invention a single shaft 44 is provided for operating both of the pumps 16, 18. The pumps are driven by eccentric cams 46, 48 that fit within cylindrical portions 23, 35 of the pump bases. The cams are mounted on the shaft by bearings 50, 52, respectively, so that the shaft can be rotated without movement of the cams. However, when one of the cams is coupled to the shaft for rotation about the axis of the shaft, it moves the respective bases 22, 34 of the pumps in an up and down direction to effect pumping action in the manner described above.

A motor 54 is mounted on a housing 56 and coupled to the shaft 44 so that operation of the motor rotates the shaft. Mounted on the shaft 44 are a pair of clutches 58, 60 which are closely adjacent the cams 46, 68, respectively. The clutches are securely fixed to the shaft 44 so that when the shaft is rotated by the motor, the clutches rotate with the shaft. The clutches can be electric spring clutches. One such clutch suitable for this use is a clutch Model No. EC25CCW6MMD24 manufactured by the Reell Precision Manufacturing Corporation of St. Paul, Minn. When such a clutch is energized, it is electromagnetically coupled to the associated cam 46 or 48 to effect conjoint rotation of the cam with the energized clutch, thereby operating the associated pump. More specifically, when clutch 58 is energized, it is magnetically coupled to the cam 46 so that operation of motor 54 to rotate the shaft 44 and clutch 58 also rotates the cam 46 to operate pump 16, thereby providing replenishment solution from conduit 24 to the pump and then through conduit 26 to tank 12. Similarly, when clutch 60 is energized pump 18 is operated to provide replenishment solution to tank 14.

A control system shown diagrammatically at 62 is provided for controlling operation of the various elements of the replenishment system. More specifically, the control system is coupled by lines 64, 66 to sensors 65, 67, respectively, in tanks 12, 14 so that a signal can be provided to the control system indicating when the solutions in tanks 12, 14 need replenishment. The sensors can detect the solution level in the tanks. The control system is also connected by conduit 68 to the motor 54 so that the motor can be operated by the control system. Also, the control system can energize clutches 58, 60 through lines 70, 72, respectively.

Figure 2:
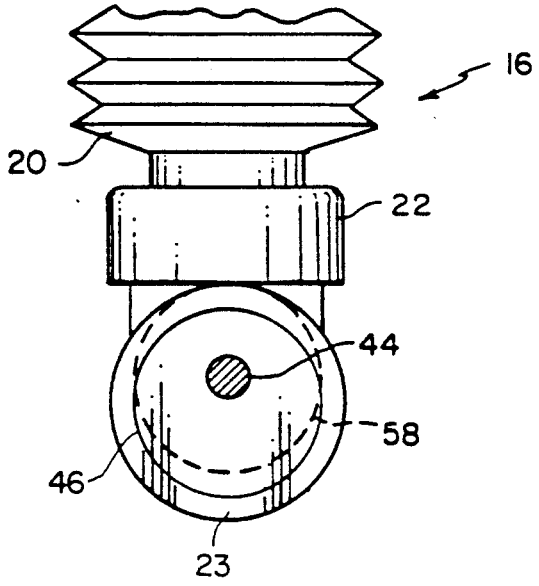
FIG. 2 is a fragmentary cross-section view taken along line 2—2 of FIG. 1.

Operation of the apparatus will now be described. Assuming initially that the solution in tank 12 needs to be replenished and that the solution in tank 14 does not need to be replenished, sensor 65 associated with tank 12 will provide a signal through line 64 to the control system 62. The control system 62 will then turn on motor 54 through line 68 to effect rotation of shaft 44. Clutch 58 is rotated with the shaft, and when the control system sends a signal along line 70 to the clutch 58, it will be electro-magnetically coupled to the cam 46 to effect rotation of the cam about the axis of the shaft 44. As shown in FIG. 2, cam 46 is eccentrically mounted relative to shaft 44 so that when it is rotated about the shaft, it drives the base 22 of the pump 16 in a vertical direction. During a cycle of operation solution is drawn through conduit 24 and the check valve 28 into the bellows 20 and then discharged through check valve 30 and conduit 26 to the tank 12, thereby replenishing the solution in that tank. During this operation the clutch 60 remains deenergized and the shaft 44 rotates with respect to the cam 48 so that no solution is provided to tank 14.

In a similar manner, replenishment solution can be provided to tank 14 while no such solution is provided to tank 12. More specifically, if a need for replenishment in tank 14 is indicated by sensor 67, a signal is provided along line 66 to the control system 62 to effect rotation of motor 54 and shaft 44. A signal provided from the control system to clutch 60 effects coupling of the clutch to the cam 48 to operate pump 18 and provide replenishment solution to tank 14.

If the sensors in tanks 12 and 14 both indicate that replenishment solution is required, the control system can energize both clutches 58 and 60 simultaneously to operate both of the pumps 16, 18 and thereby simultaneously replenish solutions in both tanks 12, 14. Thus each tank is replenished based on the need for replenishment of solution in that tank. This is a distinct advantage over prior systems wherein both pumps 16, 18 are operated each time the motor 54 is turned on, and which can result in providing an inadequate amount of solution to one tank or an excess amount of solution to another tank, or require pumps 16, 18 having different (and carefully controlled) relative volumes.

The improved pump assembly of the present invention has been described in connection with replenishment of solutions in tanks of a film processor; however, it will be understood that such a pump assembly can be utilized with other kinds of apparatus where two pumps are driven from a single motor and where it is desired to operate the pumps independently or simultaneously.

While the invention has been described in detail in regard to specific embodiments thereof, it will be understood that various changes and modifications can be effected within the scope of the claims.

I claim:

1. In a film processor having a plurality of tanks for solutions used in processing film, a plurality of pumps for providing replenishment solutions to the tanks when portions of the solutions are depleted during processing of film, and means for connecting each of the pumps to a tank and to a source of replenishment solution, the improvement comprising:

a single drive shaft for driving all of the pumps;

a motor for rotating the shaft about an axis;

a plurality of clutches, each of the clutches being coupled to the shaft and, when engaged, to one of the pumps; and means for selectively engaging the clutches individually or simultaneouly in response to sensing the levels of solutions in the tanks.

2. The invention according to claim 1 further comprising a plurality of cams for operating the pumps, bearings mounting the cams on the shaft so that the shaft can rotate with respect to the cams, and the clutches being coupled to the cams when the clutches are engaged to effect conjoint rotation of the shaft and the cams.

3. The invention as set forth in claim 2 wherein the pumps comprise bellows pumps, and the clutches are electro-magnetic clutches.

* * * * *

UNITED STATES PATENT AND TRADEMARK OFFICE

CERTIFICATE OF CORRECTION

PATENT NO. : 4,999,660

DATED : March 12, 1991

INVENTOR(S) : Thomas S. Wright

It is certified that error appears in the above-identified patent and that said Letters Patent is hereby corrected as shown below:

ON TITLE PAGE: Abstract, Lines 3-4 should read: --pumps can be operated independently, or simultaneously, by selectively engaging clutches coupled to the--.

Column 6, Line 2 should read: --ally or simultaneously in response to sensing the--.

Signed and Sealed this

Fourth Day of August, 1992

*Attest:*

DOUGLAS B. COMER

*Attesting Officer*

*Acting Commissioner of Patents and Trademarks*